United States Patent [19]

Aoki et al.

[11] Patent Number: 4,943,505

[45] Date of Patent: Jul. 24, 1990

[54] DEVELOPER AND TONER COMPOSITION PRODUCED BY EMULSION POLYMERIZATION

[75] Inventors: Takayoshi Aoki; Yukihiro Ishii; Koichi Tanaka; Shigeru Sadamatsu, all of Kanagawa, Japan

[73] Assignee: Fuji Xerox Co., Ltd., Tokyo, Japan

[21] Appl. No.: 708,902

[22] Filed: Mar. 6, 1985

[30] Foreign Application Priority Data

Mar. 6, 1984 [JP] Japan ..... 59-41304
Mar. 6, 1984 [JP] Japan ..... 59-41312

[51] Int. Cl.[5] ..... G03G 9/08

[52] U.S. Cl. ..... 430/109; 430/137; 430/111

[58] Field of Search ..... 430/137, 138, 111, 109

[56] References Cited

U.S. PATENT DOCUMENTS

| | | | |
|---|---|---|---|
| 3,634,251 | 1/1972 | Maeda et al. | 430/137 |
| 3,779,926 | 12/1973 | Merck | 430/110 X |
| 3,840,464 | 10/1974 | Van Engeland | 430/108 |
| 4,002,570 | 1/1977 | Lindblad et al. | 430/110 |
| 4,395,485 | 7/1983 | Kashiwagi et al. | 430/110 X |
| 4,439,510 | 3/1984 | McLoughlin | 430/137 |
| 4,448,871 | 5/1984 | Tomaki et al. | 430/137 X |
| 4,507,378 | 3/1985 | Wada et al. | 430/137 |

*Primary Examiner*—J. David Welsh
*Attorney, Agent, or Firm*—Sughrue, Mion, Zinn, Macpeak & Seas

[57] ABSTRACT

A developer for an electrostatic latent image is described, which comprises a toner powder and a fine powder having a particle size smaller than that of the toner powder, said fine powder being made of a polymer obtained by soap-free emulsion polymerization.

12 Claims, No Drawings

DEVELOPER AND TONER COMPOSITION PRODUCED BY EMULSION POLYMERIZATION

BACKGROUND OF THE INVENTION

The present invention relates to a developer, and more particularly, to a developer designed to experience minimum deterioration in its characteristics.

The electrostatic latent image formed in electrophotography or electrostatic recording can be made visible, or developed, by a variety of techniques. In one method, a developer made of a mixture of toner and carrier is used and the toner particles that are charged by triboelectrification upon mixing with carrier beads are attracted to oppositely charged sites on the photoreceptor or electrostatic recording element so as to produce a visible toner image. This toner image is transferred to a receiving sheet and fixed to reproduce a copy of the original. Because of incomplete transfer to the receiving paper, a toner image remains on the photoreceptor or electrostatic recording element and therefore it must be cleaned before another copying cycle is started. This residual toner image is conventionally wiped off with a blade, brush (U.S. Pat. No. 2,832,977) or Web (U.S. Pat. No. 3,186,838). As the copying cycle is repeated several thousand to several tens of thousand times, a gradual buildup of the residual toner occurs on the surface of the photoreceptor or electrostatic recording element in spite of the cleaning step. In order to avoid this insufficient cleaning or "toner filming", methods of mixing an additive with the developer composition have been proposed in British Patent No. 1,233,869, Japanese Patent Publication No. 1130/76, Japanese Patent Application (OPI) Nos. 120631/75 and 84741/77 (the term "OPI" as used herein refers to a "published unexamined Japanese patent application"). The additives proposed are organic polymers having low surface energy such as polytetrafluoroethylene and polyvinylidene fluoride (British Patent No. 1,233,869), non-clinging polymers whose static propensity is smaller than that of sulfur (Japanese Patent Publication No. 1130/76), a mixture of such non-clinging polymer and an abrasive such as colloidal silica (Japanese Patent Application (OPI) No. 120631/75), and polystyrene particles (Japanese Patent Application (OPI) No. 84741/77). These materials either reduce the sticking of the toner to the photoreceptor or electrostatic recording element or polish away the residual toner particles and hence are effective to some extent in preventing insufficient cleaning or toner filming. However, the toner in the developer containing such additives is not as effectively charged by triboelectrification as in the developer containing no such additives. This reduces the useful life of the developer and requires its frequent change. As the number of copying cycles exceeds 10,000~20,000, either a decreased image density or an increased fog occurs to such an extent that no further copying is possible. This phenomenon is particularly conspicuous in a hot and humid environment. The amount of static charge on the toner that has been used for reproducing 10,000 to 20,000 copies is about 30 to 40% smaller than the initial value. Since the photoreceptor in this stage is free from the "toner filming", the decreased image density or increased fog is believed to have resulted from the decreased ability of the developer to charge the toner particles by triboelectrification.

SUMMARY OF THE INVENTION

An object of the present invention, therefore, is to provide a developer that does not cause insufficient cleaning or toner filming on the photoreceptor or electrostatic recording element, while preventing the occurrence of a decreased image density or increased fog.

As a result of various studies made to attain this purpose, the present inventors have found that very good results can be achieved by using a developer comprising toner particles and the fine particles of a polymer that is prepared by soap-free emulsion polymerization and which an average size smaller than that of these toner particles. The present invention has been accomplished on the basis of this finding. The developer in accordance with the present invention can be completely cleaned off without causing damage to the latent image forming member and without presenting any adverse effects on the developer such as its deterioration and shortened service life.

DETAILED DESCRIPTION OF THE INVENTION

The method of soap-free emulsion polymerization by which the polymer for use in the present invention is prepared is carried out in the absence of the emulsifier that is conventionally used in the emulsion polymerization or in the presence of an alternative to such emulsifiers.

The emulsion polymerization is a method of polymerizing monomers in water with the aid of an emulsifier by addition of a water-soluble initiator. The emulsifier may be anionic, nonionic or cationic. Anionic emulsifiers include sodium salts of higher alcohol sulfate esters, sodium alkyldiphenyletherdisulfonate, sodium alkylbenzenesulfonate, sodium dialkylsulfosuccinate, sodium or potassium salts of aliphatic acids, alkyl (or alkylphenyl)ether, and sodium or ammonium sulfate; nonionic emulsifiers include alkylphenol ethylene oxide adducts, higher alcohol ethylene oxide adducts and polypropylene glycol ethylene oxide adducts; and illustrative cationic emulsifiers are quaternary ammonium salts.

Such emulsifiers are not used in the soap-free emulsion polymerization, and instead:

1. a reactive emulsifier is used;
2. relatively hydrophilic monomers (e.g., vinyl acetate, methyl acrylate, ethyl acrylate and acrylonitrile) are polymerized by addition of a persulfate salt type initiator (e.g., potassium persulfate and sodium thiosulfate) without using any emulsifier;
3. special water-soluble monomers (e.g., acrylic acid and methacrylic acid) which may be ionic or nonionic are copolymerized;
4. water-soluble polymers or oligomers are substituted for the emulsifiers;
5. decomposable emulsifiers are used; or
6. cross-linkable emulsifiers are used.

The reactive emulsifiers are those which have an addition-polymerizable double bond in the molecule and may be illustrated by the following compounds:

Acrylic Acid Derivatives:

$R_1CH{=}C(R_2)CONHSO_3M$

-continued

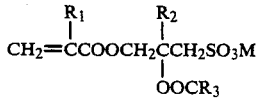

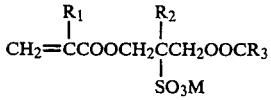

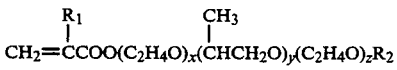

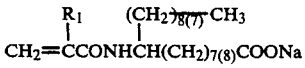

Itaconic Acid Derivatives:

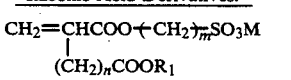

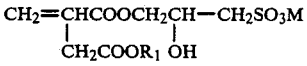

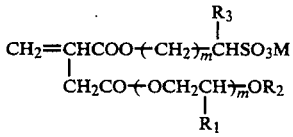

Maleic Acid Derivatives:

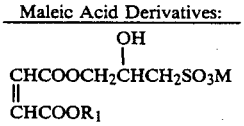

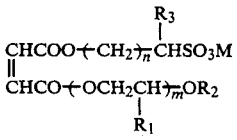

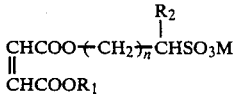

Fumaric Acid Derivatives:

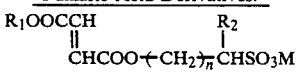

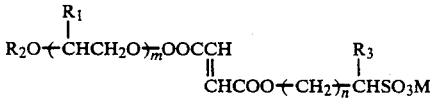

Allyl Alcohol Derivatives:

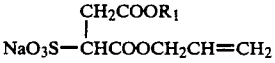

In the above formulas, $R_1$, $R_2$ and $R_3$ each represents an alkyl group, an alkoxy group, an aryl group, an aralkyl group and an amino group, M represents sodium, potassium, aluminium, manganese and zinc, and x, y, z, m and n each is an integer.

These reactive emulsifiers are in detail described in, for example, Japanese Patent Publication Nos. 12472/71, 34894/71, 44157/76, 29657/81 and 46291/74, Japanese Patent Application (OPI) Nos. 144317/79, 11525/80, 28208/81, 30285/76 and 30284/76, and B. W. Greene et al, *J. Colloid Int. Sci,* vol. 32.

In accordance with the present invention, the starting monomers are dispersed in a medium, usually water, without the emulsifiers used in conventional emulsion polymerization or with the aid of one of the materials shown in 1 to 6 (e.g., the reactive emulsifiers, water-soluble monomers etc.), and a water-soluble initiator (e.g., potassium persulfate, ammonium persulfate, azobisisobutylamidine-hydrochloric acid, etc.) is added in an amount of 0.1 to 1 wt% based on the weight of the monomers to start the polymerization of the monomers, thereby forming an emulsion of the resulting polymer. The emulsion is then dewatered, dried and reduced to fine particles of the polymer.

The method of soap-free emulsion polymerization has the following advantages:

(1) Completely spherical polymer particles are obtained;

(2) Polymer particles having a very small size distribution are obtained;

(3) Polymer particles having the appropriate and desired size are more easily obtained than by the ordinary emulsion polymerization or suspension polymerization;

(4) The entire absence of the residual emulsifier (which may occur in the ordinary emulsion polymerization) enables the production of polymer particles whose static propensity does not depend on the humidity;

(5) The absence of the residual emulsifier is also effective in eliminating the possibility of imparing the chargeability of the toner or carrier.

The monomers that can be polymerized by the soap-free emulsion polymerization in accordance with the present invention are not limited to any particular type, but suitable monomers should be selected by taking into account the chargeability of the toner or carrier. Illustrative addition-polymerizable monomers that can be used in the present invention are listed below:

styrene; alkylstyrenes such as methylstyrene, dimethylstyrene, trimethylstyrene, ethylstyrene, diethylstyrene, triethylstyrene, propylstyrene, butylstyrene, hexylstyrene, heptylstyrene and octylstyrene; halogenated styrenes such as fluorostyrene, chlorostyrene, bromostyrene, dibromostyrene and iodostyrene; as well as nitrostyrene, acetylstyrene and methoxystyrene.

Addition-polymerizable unsaturated carboxylic acids may also be used, and they include addition-polymerizable unsaturated aliphatic monocarboxylic acids such as acrylic acid, methacrylic acid, α-ethylacrylic acid, crotonic acid, α-methylcrotonic acid, α-ethylcrotonic acid, isocrotonic acid, tiglic acid, and ungulinic acid; as well as addition-polymerizable unsaturated aliphatic dicarboxylic acids such as maleic acid, fumaric acid, itaconic acid, citraconic acid, mesaconic acid, glutaconic acid and dihydromuconic acid.

These carboxylic acids may be used in the form of metal salts. The formation of such metal salts may be effected after the completion of polymerization. The addition-polymerizable unsaturated carboxylic acids may also be esterified with alcohols such as alkyl alcohols, halogenated alkyl alcohols, alkoxyalkyl alcohols, aralkyl alcohols and alkenyl alcohols. Exemplary alcohols are listed below:

alkyl alcohols such as methyl alcohol, ethyl alcohol, propyl alcohol, butyl alcohol, amyl alcohol, hexyl alcohol, heptyl alcohol, octyl alcohol, nonyl alcohol, dodecyl alcohol, tetradecyl alcohol and hexadecyl alcohol; halogenated alkyl alcohols wherein part of such alkyl alcohols is halogenated; alkoxyalkyl alcohols such as methoxyethyl alcohol, ethoxyethyl alcohol, ethoxyethoxyethyl alcohol, methoxypropyl alcohol and ethoxypropyl alcohol; aralkyl alcohols such as benzyl alcohol, phenylethyl alcohol, and phenylpropyl alcohol; and alkenyl alcohols such as allyl alcohol and crotonyl alcohol.

Other usable monomers include amides and nitriles derived from such addition-polymerizable unsaturated carboxylic acids; aliphatic monoolefins such as ethylene, propylene, butene and isobutylene; halogenated aliphatic olefins such as vinyl chloride, vinyl bromide, vinyl iodide, 1,2-dichloroethylene, 1,2-dibromoethylene, 1,2-diiodoethylene, isopropenyl chloride, isopropenyl bromide, allyl chloride, allyl bromide, vinylidene chloride, vinyl fluoride and vinylidene fluoride; and conjugated diene type aliphatic diolefins such as 1,3-butadiene, 1,3-pentadiene, 2-methyl-1,3-butadiene, 2,3-dimethyl-1,3-butadiene, 2,4-hexadiene and 3-methyl-2,4-hexadiene. Vinyl acetates, vinyl ethers, and nitrogen-containing vinyl compounds such as vinylcarbazole, vinylpyridine and vinylpyrrolidone may also be used.

Particularly preferred monomers are styrene, methyl acrylate, ethyl acrylate, propyl acrylate, butyl acrylate, methyl methacrylate, ethyl methacrylate, propyl methacrylate, butyl methacrylate, acrylic acid and methacrylic acid.

The resulting polymer should contain at least one of these monomers.

The fine powder in accordance with the present invention may be comprised of a homopolymer or copolymer of the monomers listed above.

The fine particles of the polymer shown above that is obtained by soap-free emulsion polymerization may assume irregular shapes or any other forms such as spherical, tabular or granular, but substantially round particles are preferred.

Such fine particles are incorporated in the developer by various techniques. For example, they are first blended with toner particles or carrier particles, and the mixture is then incorporated in the developer. Alternatively, the fine particles of the polymer may be directly blended in the developer.

The fine particles of one polymer may be used in combination with those of another polymer. If desired, other additives may also be used in combination with the fine particles of the present invention.

The fine particles according to the present invention must have an average size smaller than that of the toner particles. Particularly good results are obtained by particles each having a size in the range of 0.05 to 5 μm, preferably 0.1 to 2 μm. More preferably, almost all of the particles should have a size between 0.1 and 0.5 μm.

The fine particles according to the present invention may be used in an amount of 0.01 to 10 wt% of the toner. Better results are obtained by using the particles in an amount of 0.05 to 2.0 wt% of the toner.

The developer of the present invention is prepared by blending known toners with the fine particles of polymer that has been obtained by soap-free emulsion polymerization. The binder resin used in the toner is selected from among homopolymers and copolymers of the following illustrative monomers: styrenes such as styrene, chlorostyrene and vinylstyrene; monoolefins such as ethylene, propylene, butylene and isobutylene; vinyl esters such as vinyl acetate, vinyl propionate, vinyl benzoate and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone. Typical binder resins include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene and polypropylene. Other materials suitable for use as the binder resin include polyesters, polyurethane, epoxy resins, silicone resins, polyamides, modified rosin, paraffin and waxes.

The toner also contains a colorant, and typical examples of the colorant include carbon black, Nigrosine dyes, Aniline Blue, Alcohoil Blue, Chrome Yellow, Ultramarine Blue, DuPont Oil Red, Quinoline Yellow, Methylene Blue chloride, Phthalocyanine Blue, Malachite Green oxalate, Lamp Black and Rose Bengal.

Needless to say, the binder resin and colorant that can be incorporated in the toner in accordance with the present invention are not limited to the particular examples shown above.

Magnetic toners encapsulating magnetic materials may also be used.

The toner particles in accordance with the present invention generally have an average size smaller than about 30 μm, preferably between 3 and 20 μm.

The developer that has these additives incorporated therein in accordance with the present invention may be of the two-component type (carrier and toner) or of the single-component type that contains no carrier, with the two-component developer, carrier particles having an average size which is either comparable to the toner particle size or up to 500 μm. Any of the known carrier materials may be used, such as the powders of iron, nickel, cobalt, iron oxide, ferrite, glass beads, particulate silicone, and resins having magnetic particles dispersed therein.

These particles may be covered with coating agents such as fluoroplastics, acrylic resins and silicone resins.

The developer of the present invention may be employed to develop an electrostatic latent image that has been formed on a photoreceptor or an electrostatic recording element. The electrostatic latent image is formed electrophotographically on a photoreceptor made of an inorganic photoconductive material such as selenium, zinc oxide, cadmium sulfide or amorphous silicon, or an organic photoconductive material such as a phthalocyanine dye or bisazo dye. This photoreceptor may be coated with a protective layer or an insulator layer. Alternatively, the latent image may be formed by, for example, needle electrodes on an electrostatic recording element having a dielectric such as polyethylene terephthalate. The latent image is subjected to the magnetic brush development, cascade development or touchdown development so as to produce a toner image by the developer of the present invention which is attracted to selected sites on the photoreceptor or electrostatic recording element. The toner image is then transferred to a receiving sheet, usually paper, and is fixed to provide a reproduced copy. The residual toner particles are wiped off the surface of the photoreceptor or electrostatic recording element by a suitable cleaning method using a blade, brush, web or roll.

The developer of the present invention provides the following advantages.

1. Insufficient cleaning can be prevented.

The residual toner particles sticking to the surface of a photoreceptor or electrostatic recording element can be completely cleaned even after as many as fifty thousand copies have been reproduced. A developer using known additives ensures satisfactory cleaning of the residual toner if the number of copies reproduced is small. However, the removability of toner particles is gradually decreased and after more than 20,000 to 30,000 copies have been reproduced, an excessive buildup of the residual toner causes overlapping images or black stripes in the copy reproduced in the subsequent cycle.

2. The developer has a prolonged life.

The performance of the developers, particularly their ability to be charged by triboelectrification, is inevitably decreased as the number of copies reproduced is increased. This tendency is especially great in a developer using prior art additives. However, the developer of the present invention is less likely to suffer the decrease in its developing capability, and at least fifty thousand copies of an original having an image density of 0.7 which has the greatest possibility of density drop can be reproduced with satisfactory results and the decrease in density of the copied image is substantially zero. This advantage is not lost even under hot and humid conditions.

3. The developer is the least likely to cause damage to the photoreceptor or electrostatic recording element, and is substantially free from the chance of toner filming.

The advantages of the present invention will be apparent from the following Examples and Comparative Examples, which should by no means be construed as limiting the scope of the invention. In the Examples and Comparative Examples, all parts are by weight.

EXAMPLE 1

A 1,000 ml four-necked flask equipped with a stirrer, a thermometer, a nitrogen supply pipe and a reflux condenser was charged with 94 parts of methyl methacrylate and 300 parts of distilled water. As an initiator, a redox catalyst composed of potassium persulfate and sodium thiosulfate was introduced in an amount of $5\times10^{-3}$ mol/l. Simultaneously, copper sulfate was added as an accelerator in an amount of $2.5\times10^{-5}$ mol/l. Reaction was conducted at 60° C. for 90 minutes under a nitrogen stream. After completion of the polymerization, the reaction mixture was cooled to 20° C. and passed through an ultrafiltration apparatus and a hot-air drier so as to produce fine particles having an average size of 0.25 μm. The particles were substantially spherical and most of them were between 0.1 and 0.5 μm in size.

EXAMPLE 2

An apparatus which was the same as used in Example 1 was charged with 100 parts of methyl methacrylate, 200 parts of distilled water, 0.3 part of potassium persulfate and 0.2 part of polyvinyl alcohol, and the mixture was subjected to soap-free emulsion polymerization at 80° C. for 3 hours under a nitrogen stream. After completion of the polymerization, the reaction mixture was cooled to 20° C., and passed through an ultrafiltration apparatus and a hot-air drier so as to produce fine particles having an average size of 0.6 μm.

EXAMPLE 3

Toner particles with an average size of 12 μm were prepared. They contained a styrene/n-butyl methacrylate copolymer as a binder resin and used carbon black as a colorant. A 100 parts of this toner was blended in a Henschel mixer with 0.2 part of the fine particles prepared in Example 1, thereby producing a toner composition in accordance with the present invention.

EXAMPLE 4

A 100 parts of the same toner as used in Example 3 and 1.0 part of the fine particles prepared in Example 2 were mixed by the same method as used in Example 3, thereby producing a toner composition in accordance with the present invention.

EXAMPLE 5

An apparatus which was the same as used in Example 1 was charged with 36 parts of styrene, 400 parts of distilled water and 0.1 part of potassium persulfate, and the mixture was subjected to soap-free emulsion polymerization at 70° C. for 24 hours under a nitrogen stream. After completion of the polymerization, the reaction mixture was cooled to 20° C., and passed through an ultrafiltration apparatus and a hot-air drier so as to produce fine particles having an average size of 0.4 μm. 0.5 part of these particles was blended in a Henschel mixer with 100 parts of the toner used in Example 3, thereby producing a toner composition in accordance with the present invention.

COMPARATIVE EXAMPLE 1

A 100 parts of the same toner as used in Example 3 and 1.0 part of calcium stearate (average particle size: 0.6 μm) were blended in a Henschel mixer so as to produce a toner composition.

COMPARATIVE EXAMPLE 2

The toner used in Example 3 was immediately employed as a toner (i.e., with no additives).

EXPERIMENT

Spherical iron oxide particles (average size: 100 μm) were covered with a coat of styrene/methyl methacrylate copolymer so as to prepare carrier particles. Samples of these carrier particles were mixed with the toner composition of Examples 3 to 5 and Comparative Examples 1 to 2, so as to provide developer samples. A test for reproducing 50,000 copies was conducted with a photocopier Model 4370 of Fuji Xerox Co., Ltd. using the respective developer samples. The results of this copying test are summarized in the following table, from which one can clearly see the superior properties of the developers prepared in accordance with the present invention.

TABLE

| Developer Sample | Factors | | | | | |
|---|---|---|---|---|---|---|
| | | | | Static Amount (μC/g) | | |
| | Poor Cleaning | Flaws on Photoreceptor | Toner Filming | Initial | After Reproduction of 50,000 Copies | Developer Life* |
| Example 3 | None before 50,000 copies were reproduced | None | None | 15 | 17 | >50,000 |
| Example 4 | None before 50,000 copies were reproduced | " | " | 18 | 16 | " |
| Example 5 | None before 50,000 copies were reproduced | " | " | 18 | 12 | " |
| Comparative Example 1 | Six cases during the reproduction of 50,000 copies | " | Occurred | 18 | 35 | 30,000 |
| Comparative Example 2 | More than 50 cases during the reproduction of 50,000 copies | Extensive (three replacements of the photoreceptor were necessary) | " | 12 | 8 | 40,000 |

*The life of the developer is indicated in terms of the number of copies of an original with an image density of 0.7 that could be reproduced at a density of at least 0.7 and a fog density of not higher than 0.02.

While the invention has been described in detail and with reference to specific embodiments thereof, it will be apparent to one skilled in the art that various changes and modifications can be made therein without departing from the spirit and scope thereof.

What is claimed is:

1. A toner composition comprising a toner powder and a fine powder having a particle size of from 0.05 to 5 μm and which is smaller than that of the toner powder, wherein said fine powder is present in an amount of from 0.01 to 10 wt % of the toner powder and is made of a polymer obtained by emulsion polymerization of a hydrophilic monomer using a persulfate salt type initiator in the absence of an emulsifier wherein said hydrophilic monomer is selected from the group consisting of methyl acrylate, ethyl acrylate, propyl acrylate, butyl acrylate, methyl methacrylate, ethyl methacrylate, propyl methacrylate, butyl methacrylate, acrylic acid, methacrylic acid, vinyl acetate, and acrylonitrile.

2. A toner composition according to claim 1, wherein said fine powder comprises substantially spherical particles.

3. A toner composition according to claim 1, wherein the particle size of the fine powder ranges from 0.1 to 2 μm in size.

4. A developer comprising carrier particles, a toner powder and a fine powder having a particle size of from 0.05 to 5 μm and which is smaller than that of the toner powder, wherein said fine powder is present in an amount of from 0.01 to 10 wt % of the toner powder and is made of a polymer obtained by emulsion polymerization of a hydrophilic monomer using a persulfate salt type initiator in the absence of an emulsifier wherein said hydrophilic monomer is selected from the group consisting of methyl acrylate, ethyl acrylate, propyl acrylate, butyl acrylate, methyl methacrylate, ethyl methacrylate, propyl methacrylate, butyl methacrylate, acrylic acid, methacrylic acid, vinyl acetate, and acrylonitrile.

5. A developer according to claim 4, wherein each of said carrier particles consists of a core material and a surface coat.

6. A toner composition according to claim 1, wherein the emulsion polymerization is carried out in the presence of a water-soluble polymer or oligomer.

7. A toner composition according to claim 3, wherein the particle size of the fine powder ranges from 0.1 to 0.5 μm.

8. A toner composition according to claim 1, wherein the amount of the fine powder is from 0.05 to 2.0 wt % of the toner powder.

9. A toner composition according to claim 1, wherein the toner powder has an average size of from 3 to 20 μm.

10. A toner composition according to claim 1, wherein said hydrophilic monomer is dispersed in an aqueous medium.

11. A toner composition according to claim 1, wherein said persulfate salt type initiator is potassium persulfate or sodium thiosulfate.

12. A toner composition according to claim 6, wherein said water-soluble polymer or oligomer is polyvinyl alcohol.

* * * * *